US012090549B2

(12) United States Patent
Inoue et al.

(10) Patent No.: US 12,090,549 B2
(45) Date of Patent: Sep. 17, 2024

(54) METHOD FOR MANUFACTURING POROUS METAL BODY, AND POROUS METAL BODY

(71) Applicant: Toho Titanium Co., Ltd., Kanagawa (JP)

(72) Inventors: Yosuke Inoue, Kanagawa (JP); Syogo Tsumagari, Kanagawa (JP); Yasuhiko Goto, Kanagawa (JP)

(73) Assignee: Toho Titanium Co., Ltd., Kanagawa (JP)

( * ) Notice: Subject to any disclaimer, the term of this patent is extended or adjusted under 35 U.S.C. 154(b) by 0 days.

(21) Appl. No.: 17/794,300

(22) PCT Filed: Dec. 15, 2020

(86) PCT No.: PCT/JP2020/046805

§ 371 (c)(1),
(2) Date: Jul. 21, 2022

(87) PCT Pub. No.: WO2021/171747

PCT Pub. Date: Sep. 2, 2021

(65) Prior Publication Data

US 2023/0084462 A1 Mar. 16, 2023

(30) Foreign Application Priority Data

Feb. 27, 2020 (JP) ..... 2020-032181

(51) Int. Cl.
*B22F 1/16* (2022.01)
*B22F 1/142* (2022.01)
(Continued)

(52) U.S. Cl.
CPC ..... *B22F 1/16* (2022.01); *B22F 1/142* (2022.01); *B22F 1/145* (2022.01); *B22F 3/1007* (2013.01);
(Continued)

(58) Field of Classification Search
CPC ..... B22F 1/16; C22C 1/0458; C22C 14/00; C23C 8/10–12; C23C 8/16; C23C 8/80
See application file for complete search history.

(56) References Cited

U.S. PATENT DOCUMENTS 7,297,271 B2 * 11/2007 Onishi ..... C25B 11/031 429/522
10,307,824 B2 * 6/2019 Kondoh ..... C23C 8/80
2004/0115083 A1 * 6/2004 Furuta ..... C22C 32/0031 148/407

FOREIGN PATENT DOCUMENTS

CN 101032751 A * 9/2007
JP 04224601 A * 8/1992
(Continued)

OTHER PUBLICATIONS

Osaka Titanium; "Gas-Atomized Titanium Powder"; https://www.osaka-ti.co.jp/e/e_product/development/tilop64.html; retrieved from wayback on Sep. 28, 2023; wayback date—Mar. 12, 2016 (Year: 2020).*
(Continued)

*Primary Examiner* — Alexandra M Moore
*Assistant Examiner* — Austin Pollock
(74) *Attorney, Agent, or Firm* — MARSHALL, GERSTEIN & BORUN LLP

(57) ABSTRACT

A method for manufacturing a porous metal body according to the present invention includes: a surface oxidizing step of heating a titanium-containing powder in an atmosphere containing oxygen at a temperature of 250° C. or more for 30 minutes or more to provide a surface-oxidized powder; and a sintering step of depositing the surface-oxidized powder in a dry process, and sintering the surface-oxidized powder by heating it in a reduced pressure atmosphere or an inert atmosphere at a temperature of 950° C. or more.

9 Claims, 2 Drawing Sheets

(51) Int. Cl.

| | |
|---|---|
| ***B22F 1/145*** | (2022.01) |
| ***B22F 3/10*** | (2006.01) |
| ***B22F 3/11*** | (2006.01) |
| ***B22F 5/00*** | (2006.01) |
| ***C22C 14/00*** | (2006.01) |

(52) U.S. Cl.

CPC ..... *B22F 3/11* (2013.01); *B22F 5/006* (2013.01); *C22C 14/00* (2013.01); *B22F 2201/03* (2013.01); *B22F 2201/10* (2013.01); *B22F 2201/20* (2013.01); *B22F 2301/205* (2013.01); *B22F 2302/25* (2013.01); *B22F 2304/10* (2013.01)

(56) References Cited

FOREIGN PATENT DOCUMENTS

| | | | | | |
|---|---|---|---|---|---|
| JP | 05117723 | A | * | 5/1993 | |
| JP | 07278694 | A | * | 10/1995 | |
| JP | 09263929 | A | * | 10/1997 | ..... C23C 22/64 |
| JP | 2002285268 | A | * | 10/2002 | |
| JP | 2006028616 | A | * | 2/2006 | |
| JP | 2012172179 | A | * | 9/2012 | |
| JP | 2012/241241 | A | | 12/2012 | |
| JP | 2014/084505 | A | | 5/2014 | |
| JP | 2017193763 | A | * | 10/2017 | |
| JP | 2018070985 | A | * | 5/2018 | |
| JP | 2019183199 | A | * | 10/2019 | |
| WO | WO-2013/035690 | A1 | | 3/2013 | |

OTHER PUBLICATIONS

International Preliminary Report on Patentability and Written Opinion in International Application No. PCT/JP2020/046805 dated Sep. 9, 2022, 7 pages.

Search Report in International Application No. PCT/JP2020/046805 dated Feb. 16, 2021, 7 pages.

* cited by examiner

METHOD FOR MANUFACTURING POROUS METAL BODY, AND POROUS METAL BODY

FIELD OF THE INVENTION

The present invention relates to a method for manufacturing a porous metal body containing titanium, and a porous metal body.

BACKGROUND OF THE INVENTION

Titanium and titanium alloys are known to be materials having excellent corrosion resistance due to the formation of passivation films on their surfaces. It is expected that, utilizing such high corrosion resistance, the titanium or titanium alloy will be used, for example, as a porous conductive material that is used in an environment where it can be corroded and requires the necessary air permeability or liquid permeability.

For the porous metal body containing titanium, there is conventional technique as described in Patent Literature 1 and the like. Patent Literature 1 discloses a method for manufacturing a porous metal body by a wet process.

CITATION LIST

Patent Literature

[Patent Literature 1] WO 2013/035690 A1

SUMMARY OF THE INVENTION

Technical Problem

In order to produce the porous metal body containing titanium, a titanium-containing powder may be heated and sintered to provide a porous metal body as a sintered body.

Here, generally, as strength such as bending strength of in such a porous metal body is intended to increase, an air permeability or liquid permeability will decrease. This is because that if the titanium-containing powder is sintered under the action of high pressure during the production of the porous metal body, the porous metal body will form a dense sintered body, which improves the strength, but decreases the air permeability and the liquid permeability. Therefore, it can be said that the strength and the air permeability or the liquid permeability of the porous metal body are in a contradictory relationship. Accordingly, conventionally, it has been difficult to manufacture a porous metal body having both relatively high strength required depending on applications and the like, and an air permeability or liquid permeability sufficient to allow a predetermined gas or liquid to be satisfactorily permeated.

In the technique described in Patent Literature 1, a wet process is used when manufacturing the porous metal body. In this case, powders contained in the dried body are bonded to each other as they are, in the heat sintering to form a porous metal body, and as a result, the contradictory relationship is unavoidable, and both the strength and the air permeability or liquid permeability cannot be achieved.

An object of the present invention is to provide a method for manufacturing a porous metal body capable of achieving both strength and air permeability or liquid permeability at relatively high levels, and to provide a porous metal body.

Solution to Problem

As a result of intensive studies, the present inventors have devised that, prior to sintering, titanium-containing powder is separately heated in an oxygen-containing atmosphere to form an oxide layer on the surface of the powder. Then, the present inventors have found that by heating and sintering such surface-oxidized powder having the oxide layer on the surface at a predetermined temperature, the strength of the porous metal body obtained as a sintered body is improved. It is believed that this is because oxygen in the oxide layer on the surface of the surface-oxidized powder leads to solid solution and diffusion into the interior of the powder during the sintering, resulting in a strengthened porous metal body. In particular, it is believed that the effect of the solid solution and diffusion of oxygen is ensured even in a portion where the particles of the powder as a raw material are in contact with each other and bonded by sintering, achieving the strengthening of the porous metal body obtained by sintering. However, the present invention is not limited to such a theory. By utilizing this, a porous metal body having relatively high strength can be obtained without sintering the powder more precisely than necessary, so that the strength of the porous metal body can be improved while ensuring the necessary air permeability or liquid permeability.

The method for manufacturing the porous metal body according to the present invention is a method for manufacturing a porous metal body containing titanium, the method comprising: a surface oxidizing step of heating a titanium-containing powder in an atmosphere containing oxygen at a temperature of 250° C. or more for 30 minutes or more to provide a surface-oxidized powder; and a sintering step of depositing the surface-oxidized powder in a dry process, and sintering the surface-oxidized powder by heating it in a reduced pressure atmosphere or an inert atmosphere at a temperature of 950° C. or more.

The titanium-containing powder used in the surface oxidizing step preferably has an average particle diameter of 15 μm to 90 μm.

In the sintering step, the surface-oxidized powder can be deposited at least in a deposition direction without applying pressure and sintered.

In the surface oxidizing step, the titanium-containing powder has a titanium content of 75% by mass or more, an iron content of 0.08% by mass or less, an oxygen content of 0.40% by mass or less, and a carbon content of 0.02% by mass or less.

The porous metal body according to the present invention has a titanium content of 75% by mass or more, an iron content of 0.08% by mass or less, an oxygen content of 0.40% by mass to 0.80% by mass, and a carbon content of 0.001% by mass to 0.03% by mass, and a solid solution oxygen content of 0.35% by mass to 0.70% by mass.

The porous metal body as described above may be in a form of a sheet having a thickness of 5.0 mm or less.

The porous metal body as described above preferably has a porosity of 30% to 70%.

Advantageous Effects of Invention

According to the present invention, it is possible to achieve both the strength and the air permeability or the liquid permeability of the porous metal body at relatively high levels.

DETAILED DESCRIPTION OF THE INVENTION

Figure 1:
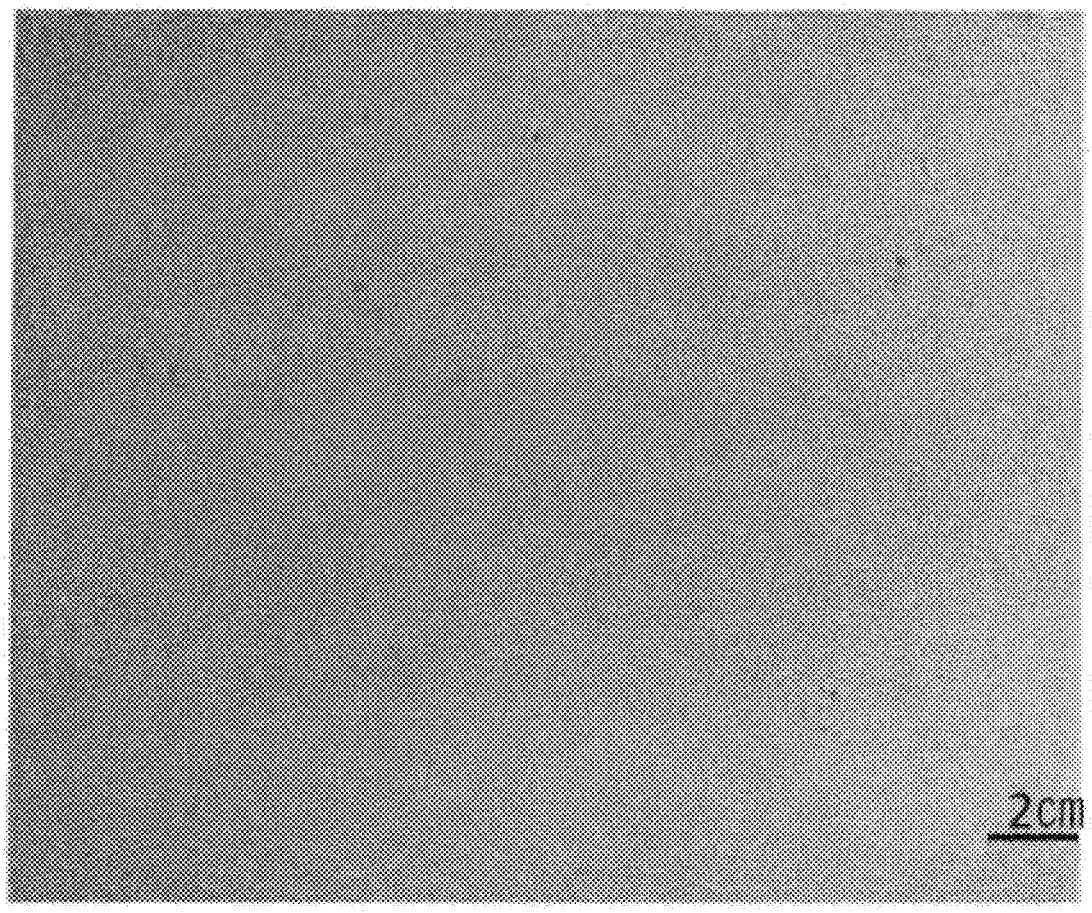
FIG. 1 is a photograph of a porous metal body manufactured as Comparative Example 6.

Hereinafter, embodiments according to the present invention will be described in detail.

A method for manufacturing a porous metal body containing titanium includes: a surface oxidizing step of heating a titanium-containing powder in an atmosphere containing oxygen at a temperature of 250° C. or more for 30 minutes or more to provide a surface-oxidized powder; and a sintering step of depositing the surface-oxidized powder in a dry process, and sintering the surface-oxidized powder by heating them in a reduced pressure atmosphere or an inert atmosphere at a temperature of 950° C. or more.

(Titanium-Containing Powder)

First, the titanium-containing powder is prepared. As the titanium-containing powder, various powders can be used as long as they contain titanium, and for example, pure titanium powder and titanium alloy powder can be used. The pure titanium powder as used herein may be powder substantially composed only of titanium, and the titanium alloy powder is powder containing titanium and an alloy element(s).

For example, the titanium alloy is an alloy of titanium and a metal(s) (alloy element(s)) such as Fe, Sn, Cr, Al, V, Mn, Zr, and Mo. Specific example includes Ti-6-4 (Ti-6Al-4V), Ti-5Al-2.5Sn, Ti-8-1-1 (Ti-8Al-1Mo-1V), Ti-6-2-4-2 (Ti-6Al-2Sn-4Zr-2Mo-0.1Si), Ti-6-6-2 (Ti-6Al-6V-2Sn-0.7Fe-0.7Cu), Ti-6-2-4-6 (Ti-6Al-2Sn-4Zr-6Mo), SP 700 (Ti-4.5Al-3V-2Fe-2Mo), Ti-17 (Ti-5Al-2Sn-2Zr-4Mo-4Cr), B-CEZ (Ti-5Al-2Sn-4Zr-4Mo-2Cr-1Fe), TIMETAL 555, Ti-5553 (Ti-5Al-5Mo-5V-3Cr-0.5Fe), TIMETAL 21S (Ti-15Mo-2.7Nb-3Al-0.2Si), TIMETAL LCB (Ti-4.5Fe-6.8Mo-1.5Al), 10-2-3 (Ti-10V-2Fe-3Al), Beta C (Ti-3Al-8V-6Cr-4Mo-4Cr), Ti-8823 (Ti-8Mo-8V-2Fe-3Al), 15-3 (Ti-15V-3Cr-3Al-3Sn), Beta III (Ti-11.5Mo-6Zr-4.5Sn), Ti-13V-11Cr-3Al and the like. In each of the above lists, the number attached in front of each alloy metal indicates the content (% by mass). For example, "Ti-6Al-4V" refers to a titanium alloy containing 6% by mass of Al and 4% by mass of V as alloy metals.

The pure titanium powder described above means powder having a titanium content of 95% by mass or more. Specific examples of the pure titanium powder, among the titanium-containing powders, include hydride de-hydride titanium powder (so-called HDH titanium powder) obtained by hydrogenating and crushing sponge titanium and then dehydrogenating it, and titanium hydride powder that has not been de-hydrogenated after the above crushing. In the titanium hydride powder, which is the pure titanium powder, a hydrogen content up to 5% by mass is acceptable.

The titanium-containing powder preferably has an average circularity of 0.93 or less. The average circularity of 0.93 or less can achieve both good air permeability and good porosity of the porous metal body. An average circularity of more than 0.93 means that the titanium-containing powder is too close to a spherical shape. That is, there is a concern that the desired strength cannot be achieved because the porosity of the porous metal body is insufficient and the contact points between the particles of the powder cannot be sufficiently ensured. The average circularity of the titanium-containing powder is preferably 0.91 or less, and more preferably 0.89 or less.

The average circularity of the titanium-containing powder is calculated as follows. A peripheral length (A) of a projected area of a particle is measured using an electron microscope, and a ratio to a peripheral length (B) of a circle having the same area as the projected area is defined as the circularity (B/A). The average circularity is determined by allowing the particles to flow in a cell together with a carrier liquid, capturing images of a large amount of particles with a CCD camera, and from 1000 to 1500 individual particle images, measuring the peripheral length (A) of the projected area of each particle and the peripheral length (B) of the circle having the same area as the projected area to calculate the circularity (B/A) as an average value of the circularity of the particles. The numerical value of the circularity increases as the shape of the particle is closer to the true sphere, and the circularity of the particle having the shape of a perfect true sphere is 1. Conversely, the circularity value decreases as the shape of the particle comes away from the true sphere.

The titanium-containing powder can be only the pure titanium powder. Alternatively, the titanium-containing powder can be a titanium alloy powder containing titanium and an alloy element(s). Their powders are appropriately selected depending on the composition of the porous metal body to be manufactured, and the like. A mass ratio of the metals in the titanium-containing powder can be, for example, titanium:alloy element=100:0 to 75:25.

The titanium content of the titanium-containing powder is preferably 75% by mass or more, and the iron content is preferably 0.08% by mass or less. For example, when the porous metal body is used as a conductive material, iron may be regarded as an impurity in such a porous metal body, and a sufficiently low iron content may be required. The iron content of the titanium-containing powder is even more preferably 0.06% by mass or less. The iron content of the titanium-containing powder is typically 0.02% by mass to 0.04% by mass.

The oxygen content of the titanium-containing powder is preferably 0.40% by mass or less, and more preferably 0.15% by mass to 0.30% by mass. With this oxygen content, HDH titanium powder generally available on the market can be applied.

The carbon content of the porous metal body may be required to be low to some extent. From this point of view, the carbon content of the titanium-containing powder is preferably 0.02% by mass or less, and particularly 0.01% by mass or less. The carbon content of the titanium-containing powder is preferably 0.005% by mass to 0.02% by mass. In this embodiment, since the slurry used in Patent Literature 1 described above is not used as described below, the use of the titanium-containing powder having a lower carbon content can lead to production of a porous metal body having a lower carbon content.

The nitrogen content of the titanium-containing powder is preferably 0.02% by mass or less, for example, 0.001% by mass to 0.02% by mass, in terms of preventing the presence of chemically extremely stable titanium nitride from inhibiting sintering.

The average particle diameter of the titanium-containing powder is preferably 15 μm to 90 μm. The use of the titanium-containing powder having such an average particle diameter can provide a titanium-containing porous metal body having both strength and air permeability at higher levels. More preferably, titanium-containing powder having an average particle diameter of 16 μm to 30 μm is used. The average particle diameter means a particle diameter D50 (median diameter) of the particle size distribution (volume basis) obtained by the laser diffraction/scattering method.

(Surface Oxidizing Step)

In the surface oxidizing step, the titanium-containing powder as described above is heated in an oxygen-containing atmosphere, for example, an air atmosphere, at a temperature of 250° C. or more for 30 minutes or more. This converts the titanium-containing powder to a surface-oxidized powder having an oxide layer containing titanium oxide such as titanium dioxide formed on the surface of the powder. The surface-oxidized powder has a higher oxygen concentration than the titanium-containing powder. Therefore, an increase in oxygen concentration can be used as an index for recognizing an approximate thickness of the oxide layer. The oxygen concentration in the atmosphere when the titanium-containing powder is heated in the surface oxidation step can be, for example, 18% by volume or more.

A heating temperature of the titanium-containing powder of less than 250° C. results in insufficient formation of the oxide on the surface of the titanium-containing powder. Therefore, the heating temperature is 250° C. or more, and preferably 300° C. or more. Further, the heating temperature may be, for example, 450° C. or less, and typically 400° C. or less, and even more preferably 350° C. or less. By suppressing the heating temperature to this level, the formation of any film that inhibits sintering can be appropriately suppressed to provide good sintering of the surface-oxidized powder in a sintering step as described below.

An excessively short retention time of the above heating temperature will also result in insufficient formation of the oxide on the surface of the titanium-containing powder. Therefore, the retention time is preferably 30 minutes or more, and the retention time is preferably 600 minutes or less. The upper limit of the retention time is, for example, 480 minutes or less, and typically 360 minutes or less, whereby an oxide layer such as an oxide film can be efficiently applied to the surface of the titanium-containing powder. Further, the retention time may be 180 minutes or less, and particularly 120 minutes or less.

(Sintering Step)

In the sintering step, the surface oxide powder obtained in the above surface oxidizing step is deposited on a flat surface such as a bottom of a mold, in a dry process rather than in a liquid (wet process), and in this state, the surface-oxidized powder is heated in a reduced pressure atmosphere or an inert atmosphere at a temperature of 950° C. or more to sinter it. This can produce a porous metal body as a sintered body. In order to ensure the effect of solid solution and diffusion of oxygen in many sites by contacting the particles of the powder as a raw material and bonding them by sintering, only the surface-oxidized powder is typically deposited by a dry process.

In the sintering step, the powder is heated to a temperature higher than a ß transformation point. For example, in the case of pure titanium, a temperature of 950° C. will be the temperature higher than the B transformation point. In the sintering step, by heating the surface-oxidized powder at the temperature of 950° C. or more firstly leads to solid solution and diffusion of oxygen in the oxide layer in the interior of each particle of the surface-oxidized powder, the oxide layer existing on the surface of each particle. Then, after the oxide layer on the surface disappears due to internal diffusion, the titanium on the surface diffuses and bonds between adjacent particles, and sintering takes place. As a result, since the powder is sintered in a state where oxygen is distributed deep inside each particle of the surface-oxidized powder used as a raw material, a porous metal body having high strength as a sintered body can be obtained.

If the sintering is carrying out using the pure titanium powder in place of the surface-oxidized powder, oxygen does not reach the deep inside of each particle making up the pure titanium powder even if an oxidation treatment is carried out after the sintering, so that the strengthening of oxygen solid solution as in the embodiment of the present invention cannot be expected. If further sintering is carried out after forming the sintered body, the voids may be reduced due to excessive sintering, and the air permeability or the liquid permeability may be deteriorated.

If the existing titanium oxide powder and pure titanium powder are mixed and sintered instead of the surface oxide powder, the particle diameter of the titanium oxide powder is finer than that of the pure titanium powder, so that it is difficult to uniformly mix both powders, the titanium oxide powder is aggregated, and oxygen is localized at the aggregated portions of the titanium oxide powder after sintering, and thus the solid solution of oxygen as in the embodiment of the present invention cannot be expected. Accordingly, even in this case, it is not possible to achieve both the desired strength and air permeability or liquid permeability.

Before starting sintering, the surface-oxidized powder is deposited on a flat surface. At this time, in order to obtain a porous metal body having a predetermined air permeability or liquid permeability, it is preferable to deposit the surface oxide powder without applying pressure at least in a deposition direction. This is because when the pressure is intentionally applied in the deposition direction, a dense porous metal body is formed after sintering, thereby deteriorating the air permeability or liquid permeability.

As an example of a method for depositing the surface oxidized powder, more specifically, for example, using a container-shaped sintering setter or mold made of carbon or the like provided with a side wall having a predetermined height surrounding the periphery on a bottom surface, the surface-oxidized powder is shaken off and deposited on the inner side of the side wall on the flat surface which is the bottom surface of the sintering setter, from the upper side of the side wall. After depositing the surface-oxidized powder on the flat surface on the inner side of the side wall of the sintering setter to some extent, a flat plate-shaped spatula or the like is moved along the upper surface of the side wall, and a part of the surface-oxidized powder rising on an upper side of the upper surface of the side wall is removed to the outside of the side wall. In this case, the surface-oxidized powder is not intentionally pressurized in the deposition direction. This can allow the surface-oxidized powder to be deposited on the inner side of the side wall of the sintering setter by the height of the side wall. By placing the surface oxide powder together with the sintering setter in a furnace and heating them, a porous metal body having a sheet shape or the like, which corresponds to the internal space of the container-shaped sintering setter, can be obtained. The thickness of the porous metal body having the sheet shape can be adjusted by changing the height of the side wall of the sintering setter or the like.

In this embodiment, the surface-oxidized powder is sintered in the sintering step in a reduced pressure atmosphere such as vacuum or in an inert atmosphere. This can prevent the titanium powder from being excessively oxynitrided during sintering. More particularly, for example, the degree of vacuum can reach 10-4 Pa to 10-2 Pa in a vacuum furnace to carry out sintering in a reduced pressure atmosphere. Further, for example, the sintering can be carried out in an inert atmosphere with the atmosphere being an argon gas. In the sintering of the present embodiment, the nitrogen gas does not correspond to the inert gas.

In the sintering step, the highest temperature during sintering is 950° C. or more. If this is less than 950° C., the decomposition of the oxide layer becomes insufficient, and the oxygen distribution in the porous metal body becomes more non-uniform, so that the strength of the porous metal body may not be appropriately increased. The highest temperature is preferably 1000° C. or more. On the other hand, the highest temperature is preferably 1200° C. or less, and more preferably 1100° C. or less. By thus preventing the temperature from being excessively increased, the progress of excessive sintering can be avoided, as well as any reaction of the porous metal body with the setter for sintering can be suppressed.

Further, in the sintering step, the highest temperature is preferably maintained for 30 minutes to 480 minutes, and more preferably 60 minutes to 360 minutes. That is, for example, a period of time at 950° C. or more as described above is preferably maintained for 30 minutes to 480 minutes, and further 60 minutes to 360 minutes. By preventing the retention time of the highest temperature from being excessively shortened, the titanium and titanium in the surface-oxidized powder adjacent to each other after the oxide layer on the surface of the surface-oxidized powder disappears are sufficiently firmly bonded to each other, so that the strength of the porous metal body can be further increased. Further, by preventing the retention time from being prolonged, any densification of the porous metal body due to excessive sintering can be suppressed, so that the porous metal body can satisfactorily exhibit the required air permeability or liquid permeability.

(Porous Metal Body)

The porous metal body that can be manufactured as described above has both strength and air permeability or liquid permeability, which have conventionally been trade-offs, at relatively high levels.

As described above, such a porous metal body has a solid solution oxygen content of 0.35% by mass to 0.70% by mass, preferably 0.37% by mass to 0.60% by mass, more preferably 0.37% by mass to 0.55% by mass, due to the surface oxidizing step carried out before the sintering step during manufacture. As used herein, the solid solution oxygen content means a value obtained by subtracting the surface oxygen concentration from the oxygen concentration of the entire porous metal body. The oxygen concentration of the entire porous metal body may employ a value measured by inert gas melting-infrared absorption spectrometry. The surface oxygen concentration may employ a value obtained by multiplying a specific surface area ($m^2/g$) obtained by the BET method using a Kr gas by the thickness of the surface oxide film and the oxygen concentration. In this case, the calculation is performed assuming that the thickness of the surface oxide film was 10 nm and the oxygen concentration in the surface oxide film was 40% by mass. In this case, a value obtained by multiplying the specific surface area ($m^2/g$) by a coefficient of 1.71 will be the surface oxygen concentration (% by mass). The measurement of the surface area by the BET method may employ, for example, BELSORP-Max from MicrotracBell Corp.

The composition of the porous metal body may be a titanium alloy, and the percentage of titanium may be 75% by mass or more. When the porous metal body is made of titanium instead of the titanium alloy, the percentage of titanium in the porous metal body may be 98% by mass or more. In the porous metal body made of titanium, the iron content may be preferably 0.08% by mass or less. In the porous metal body made of titanium alloy, the iron content may also be 0.08% by mass or less. Such a degree of the iron content is particularly suitable when the porous metal body is used as the conductive material. The iron content of the porous metal body is more preferably 0.06% by mass or less. The iron content of the porous metal body is typically 0.02% by mass to 0.04% by mass.

The oxygen content of the porous metal body is preferably 0.40% by mass to 0.80% by mass, and more preferably 0.45% by mass to 0.65% by mass. This can prevent embrittlement due to excessive strength improvement while obtaining an appropriate strength improvement effect due to the solid solution of oxygen. Since the oxygen content of the porous metal body includes the solid solution oxygen content, the oxygen content of the porous metal body typically exceeds the solid solution oxygen content.

The nitrogen content of the porous metal body is preferably 0.2% by mass or less, for example, 0.001% by mass to 0.1% by mass. The nitrogen content in this range can prevent embrittlement of the porous metal body due to the solid solution of nitrogen, and can suppress the formation of a nitride having poor corrosion resistance.

When the porous metal body is manufactured by a dry process without using a slurry containing an organic solvent as in the manufacturing method as described above, the carbon content of the porous metal body is lower than that in the case of using the slurry. This is suitable when it is used for applications for which a porous metal body having a lower carbon content is required. The carbon content of the porous metal body is preferably 0.03% by mass or less, and more preferably 0.001% by mass to 0.03% by mass, and further preferably 0.001% by mass to 0.02% by mass.

The porous metal body may have a sheet-like outer shape as a whole. In this case, it is also possible to obtain a thinner porous metal body having a thickness of 5.0 mm or less. Such a thinner porous metal body will also have relatively high strength while ensuring the required air permeability or liquid permeability. The thickness of the porous metal body may be 0.3 mm to 1.0 mm. The thickness of the porous metal body can be measured with a thickness gauge, using, for example, an ABS digital thickness gauge 547-321 from Mitutoyo Corporation.

The porosity of the porous metal body is preferably 30% to 70%, and more preferably 35% to 65%. The porosity in the range as described above can allow the air permeability or liquid permeability to be achieved depending on applications. A porosity ε of the porous metal body is measured by the following equation using an apparent density ρ' calculated from a volume and mass obtained from a width, length, and thickness of the porous metal body and a true density p of the target metal (for example, 4.51 $g/cm^3$ for pure titanium and 4.43 $g/cm^3$ for Ti-6Al-4V):

$$\varepsilon=(1-\rho'/\rho)\times 100$$

In the present embodiment, both strength and air permeability or liquid permeability can be achieved at relatively high levels. Although the strength can be represented by bending strength and the air permeability or liquid permeability can be represented by permeability, it is desirable to have an index for evaluating, at what levels, both can be achieved. Therefore, HDH titanium powder (with a titanium content of 99% by mass or more, D50 of 18 μm, D90 of 28 μm, and an average circularity of 0.89 or less) which has not been subjected to any special treatment such as surface oxidation treatment or mixing with titanium oxide powder is used to prepare a porous metal body, its bending strength B (MPa) and permeability P (μm/(Pa·s)) are actually measured and the measure values are organized. As a result, it is found that the following relationship is established between both:

$$B=0.81\times 10^{6}\cdot(P\cdot t^{0.33})^{-1.902}=k\cdot(P\cdot t^{0.33})^{-1.902}$$

The symbol t is thickness (mm) of the porous metal body, and can reflect an effect of the thickness by multiplying the permeability P by $t^{0.33}$. The symbol k is a coefficient, and if the permeability P is constant, the higher the coefficient k, the higher the bending strength B, that is, it can be considered that both the strength and the air permeability are achieved at relatively high levels. Therefore, it can be evaluated that the strength of the porous metal body is improved and the level of achieving both strength and air permeability is enhanced depending on the magnitude of the coefficient k. Although the meaning of the coefficient k in the natural sciences is not necessarily clear, it is understood that it is an index showing the strength of the bond between the particles of the titanium-containing powder. In the present invention, the value of the coefficient k can be appropriately improved by increasing the solid solution oxygen content, so that relatively high strength and air permeability with respect to the thickness can be achieved.

The k (determined by the following equation) of the titanium-containing porous metal body obtained in the present embodiment is preferably $1.1\times10^6$ to $10.0\times10^6$, and more preferably $1.5\times10^6$ to $5.0\times10^6$. Further, it is particularly preferable that the lower limit of k is $1.6\times10^6$ or more.

$$k=B/((P\cdot t^{0.33})^{-1.902})$$

The bending strength of the porous metal body is measured by a three-point bending test. The porous metal body to be subjected to the three-point bending test has a width of 15 mm and a length of 60 mm, an indenter diameter of 5 mm, a fulcrum diameter of 5 mm, and a distance between fulcrums of 25 mm. The permeability is measured using a Garley densometer. For the air capacity and the air permeation hole diameter, arbitrary values are selected so that the air permeation time falls within the range of 3 to 100 seconds.

When calculating the above coefficient k, a universal testing machine from Shimadzu Corporation can be used for the three-point bending test, and a Garley type densometer from Toyo Seiki Seisaku-sho, Ltd. can be used for measuring the permeability.

EXAMPLES

Next, porous metal bodies were experimentally manufactured by the method for manufacturing the porous metal body according to the present invention, and will be described below. However, descriptions herein are merely for illustration, and are not intended to be limited thereto.

Test Example 1

HDH titanium powder (a titanium content of 99% by mass or more and an average circularity of 0.89 or less) having a particle size distribution of D50 of 18 μm and D90 of 28 μm and an oxygen content of 0.26% by mass was prepared.

The HDH titanium powder was heated at 200° C., 250° C., 300° C., or 350° C. in an air atmosphere (an oxygen concentration of 18% by volume or more), and the oxygen content of the powder obtained by each of the above cases was measured. Each period of time where the powder was heated at each temperatures was 60 minutes or 180 minutes. The oxygen concentration of the powder after the heat treatment was determined, and the results are shown in Table 1 ("-" in Table 1 indicates that the measurement was not performed). Each HDH titanium powder had an iron content 0.04% by mass or less, a carbon content of 0.01% by mass or less, and a nitrogen content of 0.02% by mass or less.

As a result, in the powder obtained by heating the above HDH titanium powder at 200° C., the oxygen content was rarely increased, i.e., by 1.2 times, whereas in the powder obtained by heating at 250° C. or more, the oxygen content was increased by about 1.4 times to 2.4 times. Therefore, it is believed that the oxide layer was well formed on the particle surface of the HDH titanium powder when it was heated at 250° C. or more.

TABLE 1

| | O % | |
|---|---|---|
| Oxidation Treatment | 1 h | 3 h |
| 200° C. | 0.32 | — |
| 250° C. | 0.36 | — |
| 300° C. | 0.43 | 0.47 |
| 350° C. | 0.54 | 0.61 |

(Test Example 2)

HDH titanium powder having the particle diameter as shown in Table 2 and an oxygen content of 0.26% by mass was prepared. The HDH titanium powder had an iron content 0.04% by mass or less, a carbon content of 0.01% by mass or less, and a nitrogen content of 0.02% by mass or less. Also, it had a titanium content of 99% by mass or more, and the titanium-containing powder had an average circularity of 0.89 or less.

In each of Examples 1 to 9, the above HDH titanium powder was heated in an air atmosphere (with an oxygen concentration of 18% by volume or more) at the temperature and time as shown in Table 2 to form an oxide layer on the surface of the surface-oxidized powder. The surface oxide powder was then deposited in a dry process in a sintering setter with a side wall, and this was heated and sintered under the conditions as shown in Table 2 to obtain a porous metal body having a thickness of 0.3 mm. The setter for sintering that was used herein had a bottom surface inside the side wall, which had dimensions of a length of 100 mm and a width of 100 mm, and a height of the side wall of 0.35 mm. By the sintering setter, the surface oxide powder was shaken off on the bottom surface inside the side wall and deposited, and a part of the surface oxide powder raised above the upper surface of the side wall was then removed with a flat plate spatula. In the subsequent sintering, a reduced pressure atmosphere was used, and a degree of vacuum was set to a range of 10-3 pascals.

In each of Examples 10 to 13, the above HDH titanium powder was heated in an air atmosphere (with an oxygen concentration of 18% by volume or more) at the temperature and time as shown in Table 2 to form an oxide layer on the surface of the surface oxidized powder. The surface oxide powder was then deposited in a dry process in a sintering setter with a side wall, and this was heated and sintered under the conditions as shown in Table 2 to obtain a porous metal body having a thickness of 0.6 mm or 1.0 mm. The sintering setter that was used herein had an inner bottom surface of the side wall, which had dimensions of a length of 100 mm and a width of 100 mm, and a height of the side wall of 0.70 mm or 1.20 mm. Other conditions were the same as in Examples 1-9.

In Example 14, a porous metal body was produced by the same method as that of Example 1, with the exception that the temperature during sintering was 1050° C.

In each of Examples 15 and 16, a HDH titanium powder having a substantially different particle size from the above HDH titanium powder was used, and the conditions as shown in Table 2 were used to prepare a porous metal body. Other conditions were the same as those of Examples 1 to 9.

In each of Comparative Examples 1 to 4, a porous metal body was produced by substantially the same method as that of Example with the exception that the HDH titanium powder was heated and sintered without surface oxidation.

In Comparative Example 5, as shown in Table 2, a porous metal body was produced by the same method as that of Example 1 with the exception that the sintering temperature was changed to 900° C.

Figure 2:
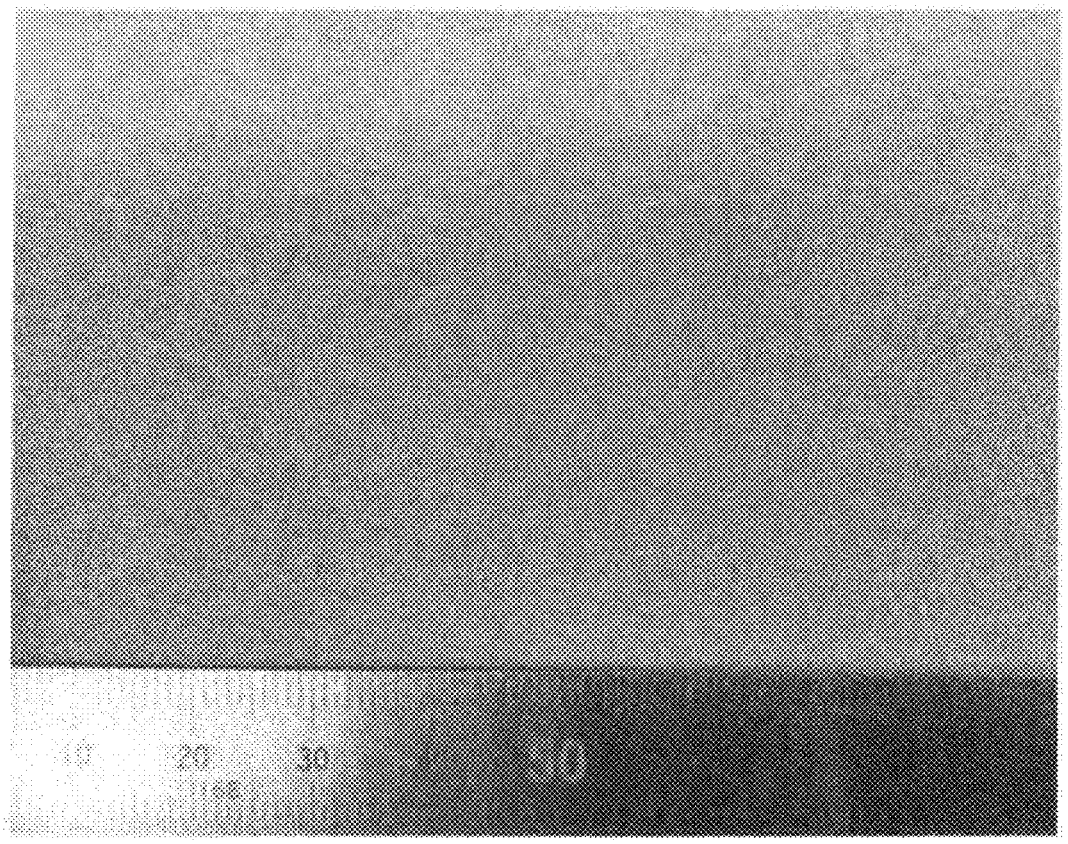
FIG. 2 is a photograph of a porous metal body manufactured as Example 3.

In Comparative Example 6, a porous metal body was prepared by the same method as that of Example 3 with the exception that the HDH titanium powder as described above and titanium oxide powder (from TOHO TITANIUM COMPANY, LIMITED (HY0210), having a titanium dioxide purity of 99.9% by mass or more and a D50 of 2.3 μm) were mixed at a mass ratio of 99.5:0.5, and the mixed powder was heated and sintered. As shown in FIG. 1, the porous metal body according to Comparative Example 6 had black spots dotted on the surface. On the other hand, in the porous metal body of Example 3, such spots were not found as shown in FIG. 2.

TABLE 2

| | HDH Titanium Powder | | Thickness t | Surface Oxidation | Sintering |
|---|---|---|---|---|---|
| | D50 | D90 | mm | Conditions | Conditions |
| Ex. 1 | 18 μm | 28 μm | 0.3 | 300° C. × 1 h | 1000° C. × 1 h |
| Ex. 2 | 18 μm | 28 μm | 0.3 | 300° C. × 1 h | 1000° C. × 6 h |

TABLE 2-continued

| | HDH Titanium Powder | | Thickness t | Surface Oxidation | Sintering |
|---|---|---|---|---|---|
| | D50 | D90 | mm | Conditions | Conditions |
| Ex. 3 | 18 μm | 28 μm | 0.3 | 300° C. × 1 h | 1000° C. × 3 h |
| Ex. 4 | 18 μm | 28 μm | 0.3 | 300° C. × 3 h | 1000° C. × 1 h |
| Ex. 5 | 18 μm | 28 μm | 0.3 | 300° C. × 3 h | 1000° C. × 3 h |
| Ex. 6 | 18 μm | 28 μm | 0.3 | 350° C. × 1 h | 1000° C. × 1 h |
| Ex. 7 | 18 μm | 28 μm | 0.3 | 350° C. × 1 h | 1000° C. × 3 h |
| Ex. 8 | 18 μm | 28 μm | 0.3 | 350° C. × 3 h | 1000° C. × 1 h |
| Ex. 9 | 18 μm | 28 μm | 0.3 | 350° C. × 3 h | 1000° C. × 3 h |
| Ex. 10 | 18 μm | 28 μm | 0.6 | 300° C. × 1 h | 1000° C. × 1 h |
| Ex. 11 | 18 μm | 28 μm | 0.6 | 300° C. × 1 h | 1000° C. × 3 h |
| Ex. 12 | 18 μm | 28 μm | 1.0 | 300° C. × 1 h | 1000° C. × 1 h |
| Ex. 13 | 18 μm | 28 μm | 1.0 | 300° C. × 1 h | 1000° C. × 3 h |
| Ex. 14 | 18 μm | 28 μm | 0.3 | 300° C. × 1 h | 1050° C. × 1 h |
| Ex. 15 | 30 μm | 47 μm | 0.6 | 350° C. × 3 h | 1000° C. × 1 h |
| Ex. 16 | 72 μm | 110 μm | 0.5 | 350° C. × 3 h | 950° C. × 1 h |
| Comp. 1 | 18 μm | 28 μm | 0.3 | Non | 900° C. × 1 h |
| Comp. 2 | 18 μm | 28 μm | 0.3 | Non | 1000° C. × 1 h |
| Comp. 3 | 18 μm | 28 μm | 0.3 | Non | 1000° C. × 3 h |
| Comp. 4 | 18 μm | 28 μm | 0.3 | Non | 1000° C. × 6 h |
| Comp. 5 | 18 μm | 28 μm | 0.3 | 300° C. × 1 h | 900° C. × 1 h |
| Comp. 6 | 18 μm | 28 μm | 0.3 | $TiO_2$ Powder Added | 1000° C. × 3 h |

For the porous metal body obtained in each of Examples 1 to 16 and Comparative Examples 1 to 6 as described above, the porosity, oxygen content, solid solution oxygen content and coefficient k as described above were calculated. The results are shown in Table 3. For the porous metal body obtained in each of Examples 1 to 16 and Comparative Examples 1 to 6, the titanium content was 98% by mass or more, the iron content was 0.04% by mass or less, and the carbon content was 0.01% by mass or less, and the nitrogen content was 0.02% by mass or less.

| | Porosity % | Permeability μm/(Pa · s) | Permeability P*t^0.33 μm/(Pa · s)*mm$^{0.33}$ | Three-Point Bending Strength MPa | Oxygen in Surface-Oxidized Powder mass % |
|---|---|---|---|---|---|
| Ex. 1 | 49 | 182.0 | 122 | 144 | 0.43 |
| Ex. 2 | 34 | 101.0 | 68 | 469 | 0.43 |
| Ex. 3 | 52 | 188.3 | 127 | 224 | 0.43 |
| Ex. 4 | 51 | 260.9 | 175 | 135 | 0.47 |
| Ex. 5 | 40 | 140.0 | 94 | 253 | 0.47 |
| Ex. 6 | 46 | 169.9 | 114 | 218 | 0.54 |
| Ex. 7 | 47 | 123.4 | 83 | 337 | 0.55 |
| Ex. 8 | 46 | 175.0 | 118 | 185 | 0.61 |
| Ex. 9 | 47 | 131.0 | 88 | 311 | 0.60 |
| Ex. 10 | 48 | 102.0 | 86 | 278 | 0.43 |
| Ex. 11 | 43 | 100.0 | 84 | 261 | 0.43 |
| Ex. 12 | 45 | 94.0 | 94 | 230 | 0.43 |
| Ex. 13 | 39 | 89.0 | 89 | 251 | 0.43 |
| Ex. 14 | 38 | 110.0 | 74 | 401 | 0.43 |
| Ex. 15 | 43 | 224.0 | 189 | 156 | 0.48 |
| Ex. 16 | 60 | 488.0 | 388 | 36 | 0.35 |
| Comp. 1 | 60 | 264.1 | 178 | 47 | 0.26 |
| Comp. 2 | 51 | 149.0 | 100 | 110 | 0.26 |
| Comp. 3 | 41 | 110.0 | 74 | 210 | 0.26 |
| Comp. 4 | 32 | 82.0 | 55 | 450 | 0.26 |
| Comp. 5 | 65 | 275.0 | 185 | 21 | 0.43 |
| Comp. 6 | 45 | 175.0 | 118 | 59 | 0.45 |

| | Oxygen in Porous Body mass % | Surface Oxygen mass % | Solid Solution Oxygen mass % | Coefficient k $10^{-6}$ |
|---|---|---|---|---|
| Ex. 1 | 0.46 | 0.11 | 0.35 | 1.3 |
| Ex. 2 | 0.46 | 0.07 | 0.39 | 1.4 |
| Ex. 3 | 0.50 | 0.12 | 0.38 | 2.2 |
| Ex. 4 | 0.56 | 0.12 | 0.44 | 2.5 |
| Ex. 5 | 0.58 | 0.09 | 0.49 | 1.4 |
| Ex. 6 | 0.57 | 0.10 | 0.47 | 1.8 |

-continued

| | | | | |
|---|---|---|---|---|
| Ex. 7 | 0.59 | 0.11 | 0.48 | 1.5 |
| Ex. 8 | 0.67 | 0.10 | 0.57 | 1.6 |
| Ex. 9 | 0.68 | 0.11 | 0.57 | 1.6 |
| Ex. 10 | 0.57 | 0.11 | 0.46 | 1.3 |
| Ex. 11 | 0.58 | 0.10 | 0.48 | 1.2 |
| Ex. 12 | 0.56 | 0.10 | 0.46 | 1.3 |
| Ex. 13 | 0.59 | 0.09 | 0.50 | 1.3 |
| Ex. 14 | 0.52 | 0.07 | 0.45 | 1.4 |
| Ex. 15 | 0.52 | 0.08 | 0.44 | 3.3 |
| Ex. 16 | 0.41 | 0.04 | 0.37 | 3.0 |
| Comp. 1 | 0.33 | 0.17 | 0.16 | 0.9 |
| Comp. 2 | 0.35 | 0.12 | 0.23 | 0.7 |
| Comp. 3 | 0.31 | 0.09 | 0.22 | 0.8 |
| Comp. 4 | 0.36 | 0.07 | 0.29 | 0.9 |
| Comp. 5 | 0.52 | 0.19 | 0.33 | 0.4 |
| Comp. 6 | 0.57 | 0.12 | 0.45 | 0.5 |

As can be seen from Table 3, in each of Examples 1 to 16, the coefficient k achieved $1.1\times10^6$ or more, which was the higher value, $1.2\times10^6$ or more. Therefore, it was found that both the strength and the air permeability could be achieved with good balance. That is, even if the thickness is changed, both the strength and the air permeability are achieved at higher levels. For the coefficient k, higher values such as $1.5\times10^6$ or more and $2.0\times10^6$ or more could be achieved. On the other hand, in each of Comparative Examples 1 to 4, the oxygen solid solution was not strengthened due to the fact that the surface oxidation treatment was not carried out, so that the coefficient k was $0.9\times10^6$ or less. In each of Comparative Examples 5 and 6, the coefficient k was in the range of $0.9\times10^6$ or less as in Comparative Examples 1 to 4, because the temperature during sintering was lower or titanium dioxide powder was mixed.

In the test results, the bending strength of each of Examples 1 to 16 and Comparative Examples 1 to 6 was in the range of 20 MPa to 470 MPa, and the permeability P×thickness $t^{0.33}$ was in the range of 50 to 400.

It is preferable that the porous metal body having a coefficient k of $1.1\times10^6$ or more has higher strength. More particularly, the three-point bending strength is preferably 100 MPa or more as in Examples 1 to 15, and more preferably 200 MPa or more as in Examples 2, 3, 5 to 7, and 9 to 14. It is preferable that the porous metal body having a coefficient k of $1.1\times10^6$ or more has a higher value of permeability P×thickness $t^{0.33}$. The value of permeability P×thickness $t^{0.33}$ is preferably 50 or more as in Examples 1 to 16, and more preferably 90 or more as in Examples 1, 3 to 6, 8, 12, 15, and 16.

As described above, according to the present invention, it is found that both the strength and the air permeability or the liquid permeability of the porous metal body can be achieved at relatively high levels.

The invention claimed is:

1. A method for manufacturing a porous metal body containing titanium, the method comprising:

a surface oxidizing step of heating a titanium-containing powder in an atmosphere containing oxygen at a temperature of 250° C. or more for 30 minutes or more to provide a surface-oxidized powder, the titanium-containing powder being a crushed powder; and a sintering step of depositing the surface-oxidized powder in a dry process, and sintering the surface-oxidized powder by heating it in a reduced pressure atmosphere or an inert atmosphere at a temperature of 950° C. or more, wherein the porous metal body is in a form of a sheet having a thickness of 5.0 mm or less and the porous metal body has a porosity of 30% to 70%, and wherein the porous metal body has a k of $1.1\times10^6$ to $10.0\times10^6$, the k being determined using a bending strength B (MPa), a permeability P (μm/(Pa·s)), and a thickness t (mm) by the following equation: $k=B/((P\cdot t^{0.33})^{-1.902})$.

2. The method according to claim 1, wherein the titanium-containing powder used in the surface oxidizing step has an average particle diameter of 15 μm to 90 μm.

3. The method according to claim 1, wherein in the sintering step, the surface-oxidized powder is deposited without applying pressure at least in a deposition direction and sintered.

4. The method according to claim 1, wherein in the surface oxidizing step, the titanium-containing powder has a titanium content of 75% by mass or more, an iron content of 0.08% by mass or less, an oxygen content of 0.40% by mass or less, and a carbon content of 0.02% by mass or less.

5. The method according to claim 1, wherein the titanium-containing powder is a hydride de-hydride titanium powder and/or a titanium hydride powder.

6. The method according to claim 1, wherein the porous metal body has a porosity of 30% to 49%.

7. The method according to claim 1, wherein in the surface oxidizing step, the heating temperature is within 250° C. to 450° C.

8. The method according to claim 1, wherein the titanium-containing powder has an average particle diameter of 16 μm to 30 μm.

9. The method according to claim 1, wherein in the sintering step, the highest temperature is within 1000° C. to 1100° C.

* * * * *